US006341910B1

(12) United States Patent
Kuehne

(10) Patent No.: US 6,341,910 B1
(45) Date of Patent: Jan. 29, 2002

(54) RETRACTABLE-TETHER LOTION APPLICATION CAP

(76) Inventor: Donald A. Kuehne, 425 W. 2nd St., Tustin, CA (US) 92780

( * ) Notice: Subject to any disclaimer, the term of this patent is extended or adjusted under 35 U.S.C. 154(b) by 0 days.

(21) Appl. No.: 09/681,149

(22) Filed: Jan. 29, 2001

(51) Int. Cl.[7] ..... A46B 5/02
(52) U.S. Cl. ..... 401/6; 401/8; 401/126
(58) Field of Search ..... 401/6, 7, 8, 9, 401/126, 127, 130; 220/212, 735; 215/228, 231, 391; 206/210; 118/235; 222/190; 15/222

(56) References Cited

U.S. PATENT DOCUMENTS 1,117,863 A * 11/1914 Larson ..... 401/127
3,130,441 A * 4/1964 Hahn ..... 401/8
4,254,645 A * 3/1981 Kouris ..... 401/9
5,690,441 A * 11/1997 McManus ..... 401/127

* cited by examiner

*Primary Examiner*—David J. Walczak

(57) ABSTRACT

A novel lotion application system that allows a person to apply lotion to difficult-to-reach places on one's body, such as one's back. When the lotion application system cap is fixed onto a bottle containing lotion, a tether can be pulled through the cap bringing with it a portion of lotion that is carried by the tether as it passes through the lotion within the bottle. A person can draw the tether over his/her body, thus transferring the lotion from the tether to the skin. After use the tether is disposed to retract into the lotion bottle.

6 Claims, 1 Drawing Sheet

RETRACTABLE-TETHER LOTION APPLICATION CAP

BACKGROUND OF INVENTION

This invention relates to lotion application systems, specifically those systems that assist a person to apply lotion to difficult to reach places on the body.

The prior art retractable tether lotion application systems use internal cylinders and/or a spring reel systems. These reels must be built into the lotion's reservoir or bottle. This makes the cost of manufacturing the unit prohibitive and unnecessarily complex. Examples of these reel-type tether lotion application systems are typified by Almond's patent U.S. Pat. No. 1,990,000,493,781, Ulrich's patent U.S. Pat. No. 4,759,652, and Whitear's U.S. Pat. No. 4,964,744.

This present invention uses an elastic tether guided through a post extending from the bottom of the cap unit. This self-contained cap assembly can be adapted to any number of existing bottle sizes and shapes and does not require special manufacturing of the lotion bottle.

SUMMARY OF INVENTION

This invention is a novel lotion application cap that allows a person to apply lotion to difficult-to-reach places on one's body, such as one's back. When the lotion application system cap is fixed onto a bottle containing lotion, a tether can be pulled through the cap bringing with it a portion of lotion that is carried by the tether as it passes through the lotion within the bottle. A person can draw the tether over his/her body, thus transferring the lotion from the tether to the skin. After use the tether is biased to retract into the lotion bottle.

This present invention obviates the problems of prior art application systems which fail to provide a system that is self-contained in a cap assembly, making it applicable to any existing container. Furthermore the present lotion application system has fewer parts and is more effective than the prior art.

Still further objects and advantages will become apparent from a consideration of the ensuing description and accompanying drawing.

DETAILED DESCRIPTION

Figure 1:
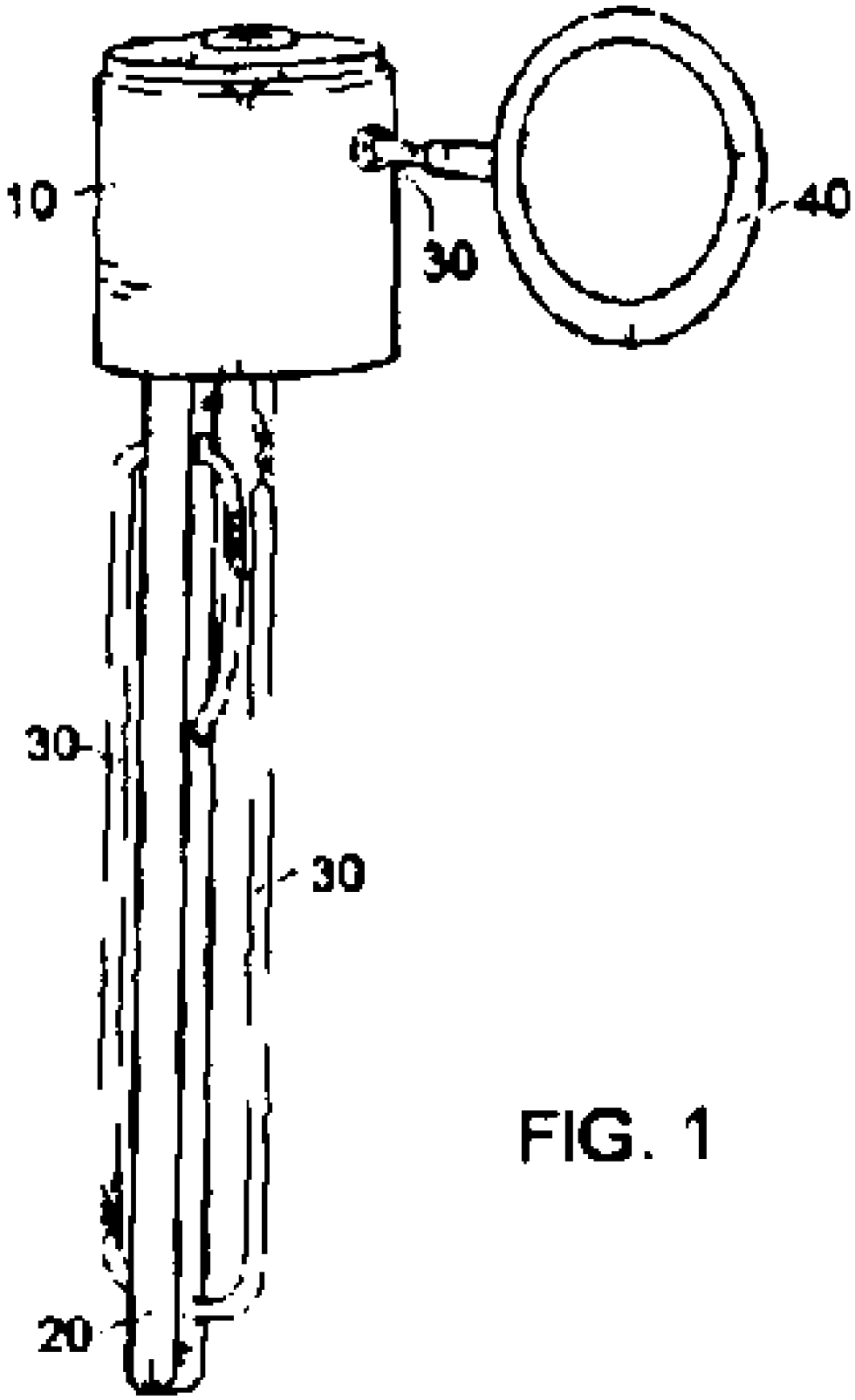
FIG. 1 is a perspective view of a preferred embodiment of the invention.

In a preferred embodiment of this present invention, a lotion application system cap, is comprised of a cap assembly having a post 20 that extends downwardly therefrom. The post 20 has guides through which the tether 30 passes. There is an opening in the cap assembly 10 through which the tether can pass. The tether 30 is substantially string-like and elastic. The post 20 adds a span of length to tension the tether 30 and is arranged so that the tether 30 is slightly energized when not in use, thus biasing the tether 30 to retract into the lotion bottle.

One end of the tether 30 is fixed to the cap assembly 10 and may pass through one or more openings or guides on the post 20, the other end of the tether 30 passes through an opening in the cap assembly 10. The tether 30 can be threaded through the openings or guides on the post 20 multiple times to increase the overall length of the tether, thus providing adequate length for the tether 30 for use when it is extracted from the opening in the of the cap assembly 10. If a substantially tall bottle is used, there would be no need for the openings or guides on the post 20 and the tether 30 could be simply secured to the post 20.

A finger loop 40 may be attached to the end of the tether 30 after it is passed through the opening in the cap assembly 10. The finger loop 40 provides a handle means and a sealing means, as well as preventing the tether 30 from being pulled back through the opening in the cap assembly 10.

Advantageously the tether 30 is elastic and has a soft semi-absorbent outer surface. The elastic tether is pre-tensioned to bias the tether 30 to remain in the bottle or container to which the cap assembly 10 has been fastened.

The base of the finger loop 40 and the opening in the cap assembly 10 are to be constructed of appropriate tolerances by one skilled in the art, so that when they are brought together they provide a sealing means to effectively close the opening in the cap assembly 10. There may be one or more additional openings in the cap assembly 10 to provide alternate methods of dispensing lotion without extracting the tether 30, especially when applying lotion to the easier to reach places on the body.

What is claimed is:

1. A fluid application system to be used by an individual to apply fluid to a person's body comprising:

a cap assembly adapted to be attached to a fluid reservoir and having an opening therethrough which extends from an underside of said cap assembly to an outer surface thereof; and a tether attached at one end to said underside of said cap assembly and having an opposite end extending though said opening in said cap assembly such that when said cap assembly is mounted on the fluid reservoir, said tether is in contact with fluid in the fluid reservoir whereby when said opposite end of said tether is pulled, said tether will extend through said opening and have a portion of the fluid thereon for allowing a user to apply the fluid and when said tether is released, said tether is retracted back into the fluid reservoir.

2. The fluid application system of claim 1 wherein said cap assembly includes a post depending therefrom and adapted to be positioned within the fluid reservoir when said cap assembly is mounted thereon wherein said one end of said tether is attached to said post.

3. The fluid application system defined of claim 2 wherein said post includes at least one opening therethrough through which said tether is threaded.

4. The fluid application system defined in claim 1 wherein said tether has a soft, semi-absorbent outer surface.

5. The fluid application system defined in claim 1 wherein a finger loop is attached to said opposite end of said tether to thereby provide a handle for the individual and prevent said opposite end of said tether from retracting through said opening in said cap assembly.

6. The fluid application system defined in claim 1 wherein said tether is an elastic tether.

* * * * *